US008857537B2

(12) United States Patent
Ahonen

(10) Patent No.: US 8,857,537 B2
(45) Date of Patent: Oct. 14, 2014

(54) METHOD AND APPARATUS FOR DOWN-THE-HOLE DRILLING

(75) Inventor: Jukka Ahonen, Tampere (FI)

(73) Assignee: Oy Atlas Copco Rotex Ab, Tampere (FI)

( * ) Notice: Subject to any disclaimer, the term of this patent is extended or adjusted under 35 U.S.C. 154(b) by 536 days.

(21) Appl. No.: 13/145,596

(22) PCT Filed: Oct. 27, 2009

(86) PCT No.: PCT/FI2009/050860
§ 371 (c)(1),
(2), (4) Date: Jul. 21, 2011

(87) PCT Pub. No.: WO2010/084238
PCT Pub. Date: Jul. 29, 2010

(65) Prior Publication Data

US 2011/0278069 A1 Nov. 17, 2011

(30) Foreign Application Priority Data

Jan. 21, 2009 (FI) ..... 20095046

(51) Int. Cl.
*E21B 7/20* (2006.01)
*E21B 10/38* (2006.01)
*E21B 21/16* (2006.01)
*E21B 21/12* (2006.01)

(52) U.S. Cl.
CPC ..... *E21B 10/38* (2013.01); *E21B 21/16* (2013.01); *E21B 21/12* (2013.01)
USPC ..... 175/22; 175/171; 175/417; 175/415; 175/257; 405/248

(58) Field of Classification Search
USPC ..... 175/257, 415, 171, 22, 417, 418; 405/232, 248, 249
See application file for complete search history.

(56) References Cited

U.S. PATENT DOCUMENTS 4,440,244 A 4/1984 Wiredal
5,590,726 A 1/1997 Jarvela et al.

(Continued)

FOREIGN PATENT DOCUMENTS

EP 0204677 A2 12/1986
WO WO-2006131339 A1 12/2006

OTHER PUBLICATIONS

PCT/ISA/210—International Search Report—Jun. 17, 2010.
PCT/ISA/237—Written Opinion of the International Searching Authority—Jun. 17, 2010.

(Continued)

*Primary Examiner* — Nicole Coy
(74) *Attorney, Agent, or Firm* — Venable LLP; Eric J. Franklin

(57) ABSTRACT

A method and apparatus for down-the-hole drilling. The drilling is carried out by a drilling device including a casing and a drilling unit. The drilling head includes a first drill for drilling a center hole, a second drill for reaming the center hole and a flushing flow arrangement including a first flusher for leading a flushing medium onto a drilling surface and a second flusher for returning of the flushing medium and drilling waste inside the casing. The first drill is removably coupled with the second drill to enable removal thereof from the hole. The casing is arranged to be drawn into a hole to be drilled by the drilling unit. The flushing medium is brought onto the drilling surface and returned therefrom by axially directed flow arrangements disposed in a cross-section view on an outer periphery of the first drill and/or in an inner periphery of the second drill.

6 Claims, 4 Drawing Sheets

(56) References Cited

U.S. PATENT DOCUMENTS

| | | | | |
|---|---|---|---|---|
| 6,702,045 | B1 * | 3/2004 | Elsby | 175/93 |
| 7,143,846 | B2 * | 12/2006 | Jarvela et al. | 175/257 |
| 8,550,191 | B2 * | 10/2013 | Hiwasa et al. | 175/393 |
| 2004/0104050 | A1 | 6/2004 | Jarvela et al. | |
| 2009/0101413 | A1 * | 4/2009 | Abt et al. | 175/57 |
| 2011/0198129 | A1 * | 8/2011 | Ahonan | 175/65 |

OTHER PUBLICATIONS

PCT/IPEA/409—International Preliminary Report on Patentability—Dec. 20, 2010.

Atlas Copco Geotechnical Engineering Products "Elemex overburden drilling system"; Atlas Copco Geotechnical Drilling and Exploration; Feb. 2010; pp. 1-8.

* cited by examiner

METHOD AND APPARATUS FOR DOWN-THE-HOLE DRILLING

CROSS-REFERENCE TO RELATED APPLICATIONS

This application is the national phase under 35 U.S.C. §371 of PCT/FI2009/050860 filed 27 Oct. 2009, and claims priority to Finnish patent application 20095046 filed 21 Jan. 2009.

FIELD OF THE INVENTION

The invention relates to a method and apparatus for down-the-hole drilling.

BACKGROUND OF THE INVENTION

For example in patent publication FI 75650 there has been presented a boring tool, which is meant for boring and/or hammer drilling, to be used in connection with a drill rod unit placed inside a mantle pipe. The boring tool to be attached at the front end of the drill rod unit has a center drill, being provided with a cutting unit, and an eccentric reaming drill, being placed after the center drill, the reaming drill having also a cutting unit. The reaming drill moves with respect to the center drill between a drilling position, in which it is positioned sidewards in front of the mantle pipe, and a return position, in which it is withdrawn in radial direction inside the mantle pipe. Deviating from earlier solutions, in which the center drill is in most cases provided with four cutting parts directed radially and being made of hard metal, the reamer for its part comprising either one or two radially directed cutting parts made of hard metal, in the solution according to the publication in question, the cutting parts are replaced by bit parts being arranged in a certain manner. With the solution presented in this publication such constructions of the center drill and the reaming drill have been aimed that the operating time of the boring tool will be as long as possible.

A way to carry out overburden drilling in a more developed manner compared to prior art, is formerly known e.g. from Finnish Patent No. 95618. The drilling head of the drilling unit of the drilling apparatus existing inside a casing part or in other words a so called casing pipe according to this patent, is formed of a first frame part and an annular second frame part, in the drilling surfaces of which there has been arranged drilling organs, such as drill bits or like, of the first and second drilling means or in other words of the pilot and the reamer. In this solution the first drilling means that is the first frame part forming the pilot, is being released from the second frame part forming the reamer in order to pull the same alone off from a drilled hole after the drilling situation. In the solution in question the second organs of the flushing means for removal of drilling waste being generated are arranged to lead drilling waste by means of an assembly belonging to the counterpart surface arrangement, which connects the said drilling means together for a drilling situation unrotatively in respect with each other and in both directions longitudinally, which, in other words, is being carried out as an advantageous embodiment by loosening grooves, belonging to a bayonet coupling, placed longitudinally in the outer periphery of the first frame part.

Particularly a so called pile drilling has rapidly become common in making of both so called micro piles and large-diameter foundation piles. An advantage of pile drilling is among other things the fact that drilled piles can be mounted quickly and accurately in a desired position, direction and depth. Straightness of the piles, verification of the bottom and accurate positioning are factors, thanks to which the pile drilling has often taken the place of pile driving particularly in demanding construction sites. A drilled pile displaces a corresponding amount of soil to its volume by bringing up the drilled soil entirely. This is why not any horizontal strains will be caused that might brake surrounding structures, which may take place when piles are rammed. Pile drilling is also relatively silent and quite shakeless (the operating frequency of the hammer is higher than the natural frequencies of soil and structures) when compared to piles being rammed. On the other hand the possibility offered by a drilled pile to get a casing pipe mounted reliably and without efforts even into a sloping rock surface, are superiority factors when comparing the method to piling by digging.

Thus a significant number of superiority factors are related to pile drilling, which in practice very often make the same as the most recommendable alternative. Thanks to the pile drilling being the most efficient piling method also by its production capacity and due to the fact that it enables piling with relatively small, easily transportable, and space-saving machines that can be put quickly into working order, also foundation constructors almost without exception take up a positive attitude towards the same.

Pile drilling uses pressurized air for operating the down-the-hole hammer and as the means for bringing up the loosened material. Careless use of air in flushing has brought about, however, some problems, solving of which is necessary for the standpoint of development regarding pile drilling.

Problems caused by flushing air can be divided in two main categories:

- Use of flushing air may overdrill an excessive amount of material on surface of the earth, in which case both the foundation to be built and surrounding structures are in danger. This is a typical situation particularly with frictional soil (sand, silt etc.),
- The second problem is due to "pushing" of air into the soil particularly in case of cohesive soil (such as clay), whereby air may get drifted around load supporting piles (e.g. rammed wood piles) existing in the neighbourhood, in which case weight carrying capacity of the pile (or piles) may decrease very quickly.

Careless use of flushing air has already led to denial of pile drilling by a down-the-hole hammer among other things in some sites, which have been grounded on support of old wood piles driven in cohesive soil, in which case air that has been "escaped" into the soil has caused sudden sinkings and cracks in buildings. On the other hand in some sites, a significantly greater amount of soil has been over drilled by flushing air than the piles have actually replaced, due to which surrounding buildings have been caused to tilt.

Because down-the-hole hammer drilling is, however, a very efficient way to operate, applicable for all soil circumstances and because the piles erected by the same are straight and reliable, the disadvantages related to its use need to be eliminated in order to enable down-the-hole hammer drilling also in the future.

As stated above, the problems caused by the use of flushing air in down-the-hole hammer drilling are usually due to poor professional skill or carelessness of the operating personnel, but in practice also drill bit structures and drilling techniques may effect essentially to arising of the problems. In this context e.g. drill bits are originally designed usually for rock drilling, whereby the flushing air must first of all be directed as efficiently as possible to the drilled point for removing of the particles quickly in order to avoid multiple crushing, and on the other hand with such a volume (and speed), that the material gets brought up through the casing. This is why the flushing openings of the drill bits are thus aimed directly at the rock surface. During drilling the flushing air may not get back upwards in rock hole, but along a hole with unbroken walls. The situation is, however, different in overburden drilling, whereby the ground may penetrate air even very easily. In this case turning of the flushing air back to the casing pipe or in connection therewith is very problematic or even impossible, if carried out by traditional drill bits. On the other hand, a large amount of air is needed for lifting of the soil, which leads also to a high velocity inside the casing pipe and to very effective blowing of flushing air directly to the soil.

Thus a very controlled circulation of flushing medium is required particularly in pile drilling, but correspondingly also in any other type of down-the-hole drilling, in which liquid, such as water is being used as flushing medium, so that the flushing medium is mainly returned back on the surface of the earth through the casing pipe, though the soil would be relatively loose. The drilling action must be performed on the other hand in a space protected as well as possible so that the pressure of the ground does not block input openings of the flushing medium or in other words so that the pressure of the flushing medium to be fed exceeds the pressure of the ground and on the other hand so that the easiest way for flushing medium from the drilled point takes place in a desired manner back to the casing pipe.

SUMMARY OF THE INVENTION

It is an aim of the method and apparatus according to the present invention to achieve a decisive improvement in the problems described above and thus to raise essentially the level of prior art.

As the most important advantages of the method and apparatus according to the invention may be mentioned simplicity and efficiency of the constructions and operating principles enabled by the same first of all thanks to the fact that it is possible to exploit therewith drill bit constructions that have already been found technically very well functionable. The invention enables extremely simple first drilling means or pilot regarding construction thereof particularly thanks to the fact that the flushing medium is both brought to the drilling surface and removed therefrom together with the drilling waste through a space between the pilot and the reamer, in which case a flushing flow is achieved that circulates very efficiently over the head of the pilot. On the other hand by providing the drilling head with a guide surface arrangement that controls passage of the flushing medium, drifting of the flushing medium to the drilling surface can be secured by simultaneously preventing entering thereof to a return flow channel prior to drifting thereof onto the drilling surface.

On the other hand, the invention enables further use of pressurized air as the flushing medium by providing the drilling head of the drilling unit when needed with a counterpart surface arrangement, which directs passage of the pressurized air flow so, that it may not get directed to the soil. By virtue of the above among other things overdrilling and foundations of surrounding structures getting damaged can be avoided, which is nowadays being tried to prevent when drilling by present technique e.g. by protective pilings limiting the drilling site, which become naturally disproportiontely expensive. With the method and apparatus according to the invention, bringing about an improvement of safety, it is thus possible to achieve also clear savings in performing of the drilling itself.

BRIEF DESCRIPTION OF THE DRAWINGS

Figure 3:
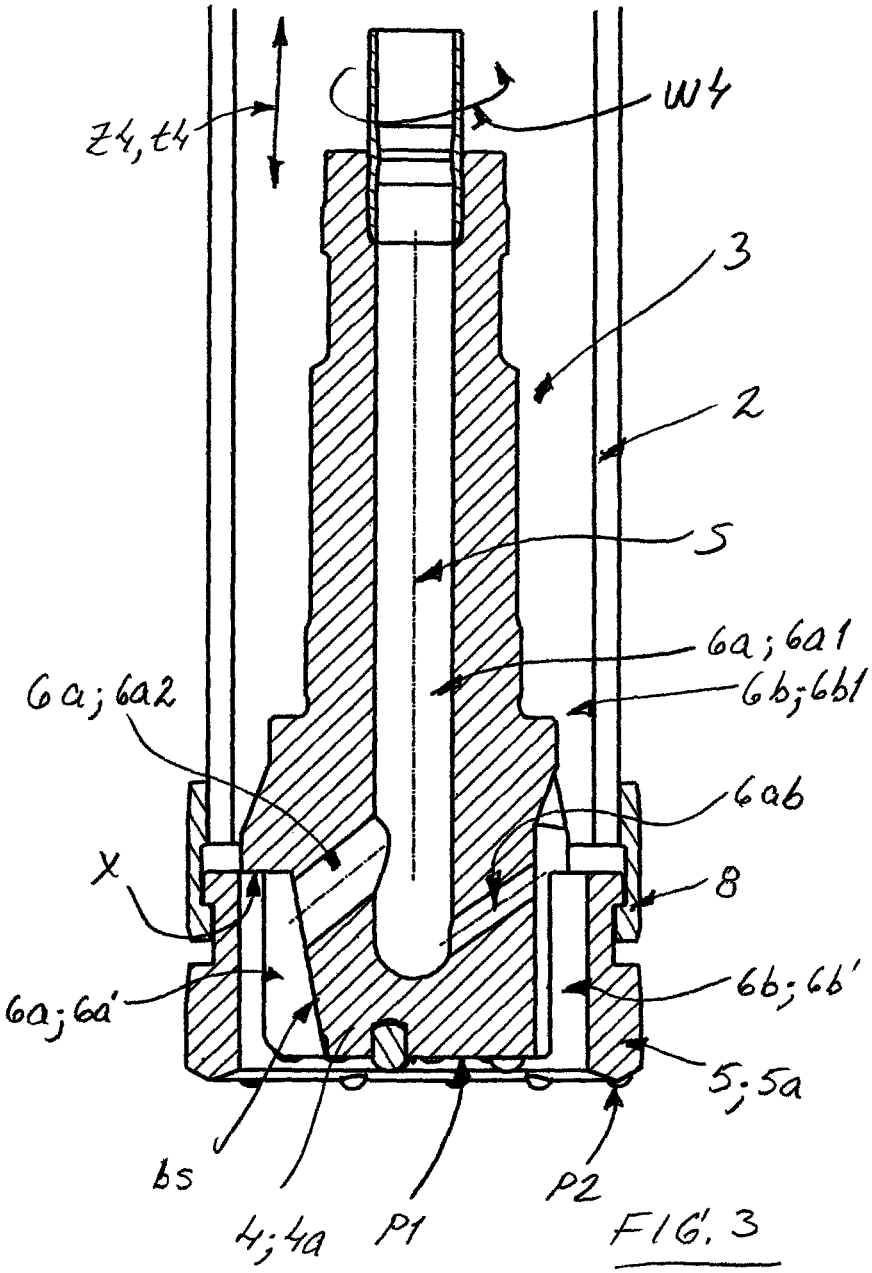
Figure 4:
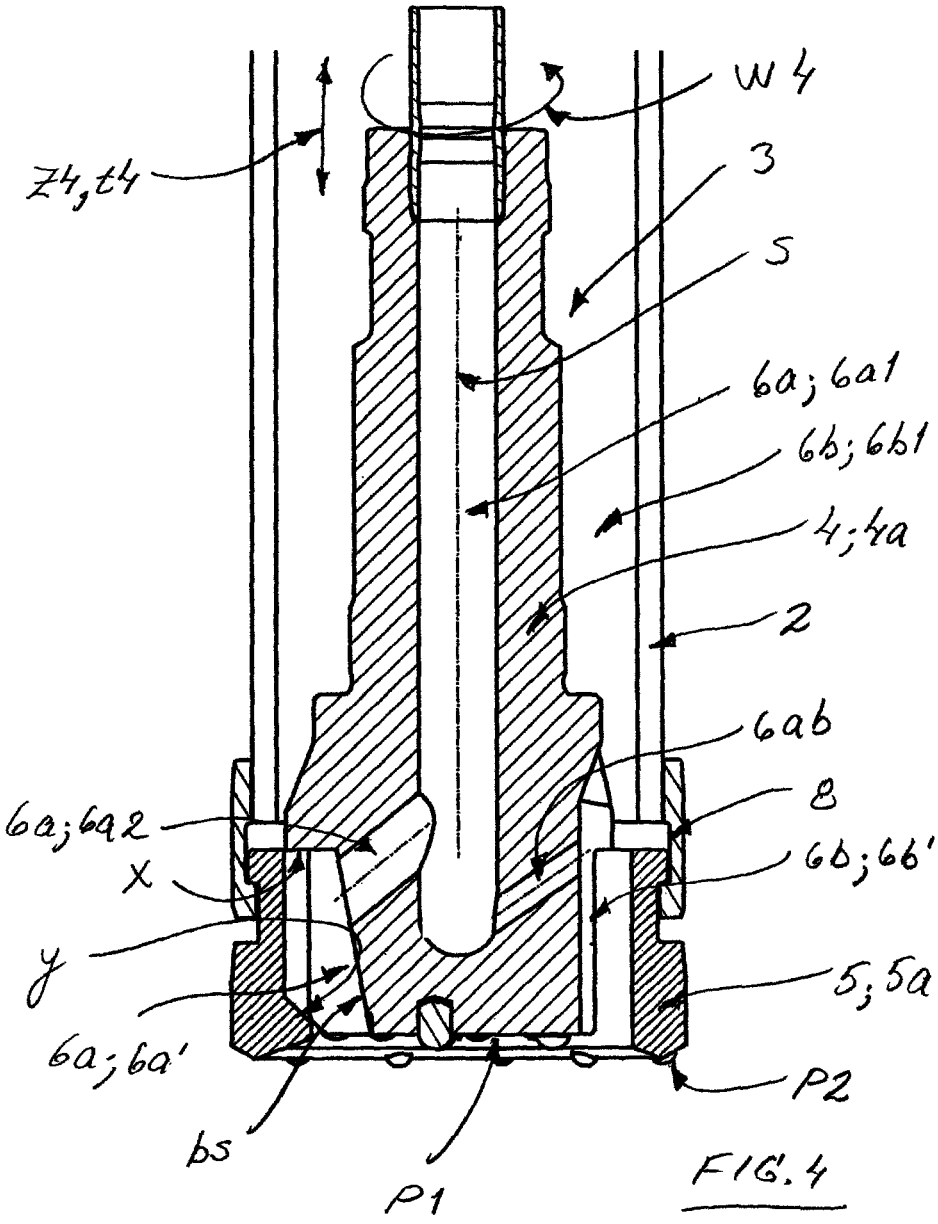

In the following description the invention is depicted in detail with reference to the appended drawings, in which in FIG. 1 is shown a partial longitudinal cross-sectional view from a drilling device construction presenting prior art, in FIGS. 2*a* and 2*b* are shown a partial longitudinal cross-sectional view from a drilling head of an advantageous drilling device applying the method according to the invention and a flushing medium flow taking place in connection therewith, and a front view as seen from the side of the drilling device's drilling surface, in FIG. 3 is shown a longitudinal cross-sectional view from an advantageous drilling device belonging to the apparatus applying the method according to the invention, and in FIG. 4 is shown an alternative or complementing implementation with respect to the one shown in FIG. 3.

The invention relates to a method for down-the-hole drilling, the drilling being carried out by an apparatus, having a drilling device 1 that comprises a casing part 2 and at least during a drilling situation an essentially inside thereof existing drilling unit 3, at a drilling head of which there are at least first drilling means 4 for drilling a center hole, second drilling means 5 for reaming the center hole for the casing part 2 and a flushing flow arrangement 6, which comprises first flushing means 6*a* for leading of a flushing medium onto a drilling surface P and second flushing means 6*b* for returning of the flushing medium and drilling waste at least partly internally inside the casing part 2. The first drilling means 4 are coupled with the second drilling means 5 first of all power-transmittedly in order to carry out cooperation thereof at least during a drilling situation with the second drilling means 5 for a rotational motion w4, an axial s feeding motion z4 and/or a hammering motion t4, and on the other hand removably in order to enable removal thereof from the hole. The casing part 2 is arranged to be drawn into a hole to be drilled by the drilling unit 3 e.g. by applying a casing shoe 8. The flushing medium is being brought onto the drilling surface P and returned from the drilling surface P together with the drilling waste by axially directed flow arrangements 6*a*; 6*a*', 6*b*; 6*b*' that exist, when viewed in a cross section, on an outer periphery of the first drilling means 4 and/or in an inner periphery of the second drilling means 5.

DETAIL DESCRIPTION OF EMBODIMENTS OF THE INVENTION

Figure 1:
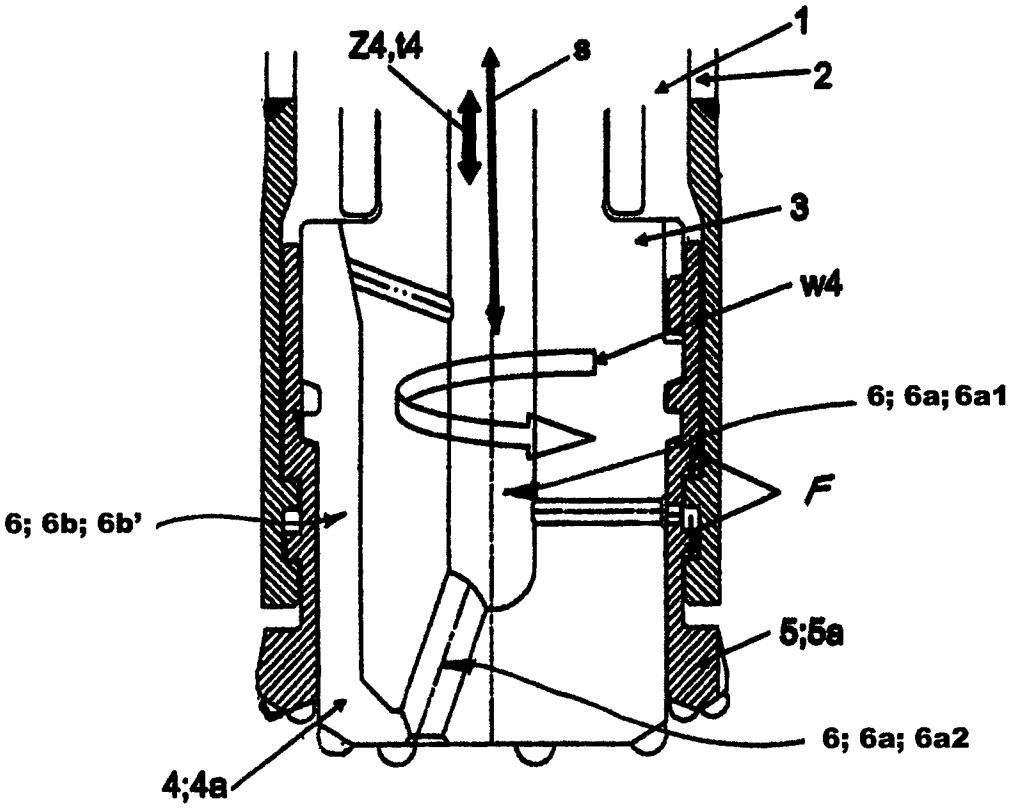
FIG 1. Prior art
Figures 2A, 2B:
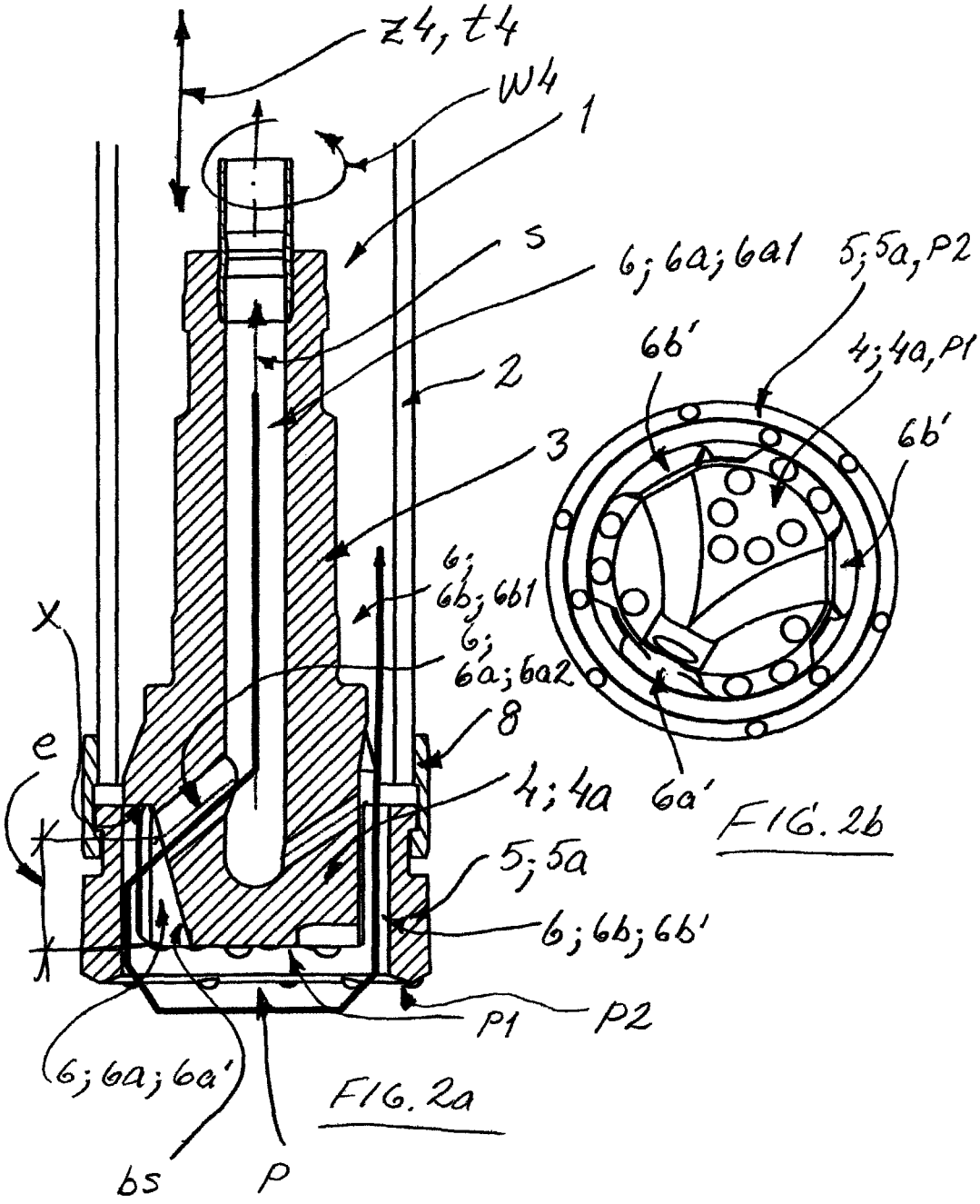

The method is being exploited advantageously when operating with a drilling apparatus, in which the drilling head of the drilling device 1 is formed e.g. as shown in FIGS. 2*a*, 3 and 4 of a first frame part 4*a* and a second frame part 5*a*, the drilling surfaces P; P1, P2 of which being provided with drilling organs of the first and the second drilling means 4, 5, such as an integrated drilling part, separate drilling pieces, bits or like, and whereby a rotationally symmetrical reamer is being used as the second drilling means 5 that has an essentially continuing drilling surface radially, when viewed in a cross-section perpendicular to a longitudinal direction s of the drilling unit 3. In this context e.g. according to the longitudinal cross-sectional views shown in FIGS. 1, 2*a*, 3 and 4 and the front view shown in FIG. 2*b*, at least the second flushing means 6; 6*b* of the flushing flow arrangement for returning of the flushing medium and the drilling waste at least partly internally inside the casing part 2 is arranged by one or several axially directed return flow channels 6*b*', being placed between the first and the second drilling means 4, 5, such as the first and the second frame parts 4*a*, 5*a*. The flushing medium is being led from a feed channel 6*a*1, being led advantageously centrically to the first drilling means 4, such as the first frame part 4*a*, by one or several distribution channels 6*a*2 directed outward therefrom into a feed flow channel 6*a*' on the outer periphery of the first drilling means 4, such as the first frame part 4*a*, at a distance e from the drilling surface P1 of the first drilling means. Thus, as manifested e.g. in FIG. 2*b*, a part of the flow arrangements between the drilling means 4, 5 being used as a feed flow arrangement 6*a*' for the flushing medium.

Furthermore as an advantageous embodiment of the method, passage of the flushing medium onto the drilling surface P is guided at the drilling head of the drilling unit 3, e.g. as shown in FIGS. 2*a*, 3 and 4, by a guide surface arrangement X existing advantageously in the first frame part 4*a* forming the first drilling means 4 or the pilot.

By means of the guide surface arrangement X in question, returning of a feed flow of the flushing medium from the feed flow channel 6*a*' to the return flow space 6*b*1 is prevented prior to drifting thereof onto the drilling surface P, in which case circulation of the flushing medium is secured as shown in FIG. 2*a* "over" the end of the pilot. Furthermore as shown in FIGS. 2*a*, 3 and 4 it is in this case thus possible to optimize the flow channels in a way that the cross-sectional area of the feed flow channel 6*a*' is increased when getting closer to the drilling surface by an inclined bottom surface bs of the flow channel 6*a*', in which case simultaneously speed of the flushing medium decreases. Furthermore on the principle disclosed in FIG. 2*b*, when bringing the flushing medium to the drilling surface P e.g. by one feed flow channel 6*a*', it is possible to make sure efficient removal of flushing medium and drilling waste from the drilling surface P by exploiting two axially directed return flow channels 6*b*' between the pilot 4 and the reamer 5.

Furthermore with reference particularly to the advantageous embodiment shown in FIG. 4, direction of the flushing medium feed flow is altered by means of a counterpart surface arrangement y essentially in connection with the drilling surface P particularly in order to decrease drifting thereof into the soil by decreasing its kinetic energy. When carried out in this way, it is possible to efficiently prevent drifting of the flushing medium into the soil, when it collides first of all with the inner surface of the reamer 5 while entering the axially directed feed flow channel 6*a*' and a second time with an inward oblique end y of the reamer while being guided from the end of the pilot 4 onto the drilling surface.

Furthermore as an advantageous embodiment, it is possible to exploit the flushing medium in a way that by means thereof the return flow is partially made more effective by one or several circulation flow channels 6*ab* as shown in FIGS. 2*a*, 3 and 4.

The invention relates also to an apparatus for down-the-hole drilling, which comprises a drilling device 1 as described above. Particularly with reference to the advantageous embodiments shown in FIGS. 2*a*, 2*b*, 3 and 4, the flushing flow arrangement 6 comprises axially directed s flow arrangements 6*a*; 6*a*', 6*b*; 6*b*', both for bringing of the flushing medium onto the drilling surface P and for returning thereof from the drilling surface P together with the drilling waste, the arrangements existing, when viewed in a cross-section, on an outer periphery of the first drilling means 4 and/or an inner periphery of the second drilling means 5.

Furthermore as an advantageous embodiment with reference to the longitudinal cross-sectional views, shown in FIGS. 2*a*, 3 and 4, the first means 6*a* of the flushing flow arrangement 6 comprise a feed channel 6*a*1, being led centrically to the first drilling means 4, such as the first frame part 4*a*, and one or several distribution channels 6*a*2, being led outward therefrom, in order to lead the flushing medium into a feed flow channel 6*a*' on the outer periphery of the first drilling means 4, such as the first frame part 4*a*, at a distance e from the drilling surface P1 of the first drilling means.

Furthermore as an advantageous embodiment, the flushing flow arrangement 6 comprises a guide surface arrangement X for guiding passage of the flushing medium onto the drilling surface P at the drilling head of the drilling unit 3. The guide surface arrangement X in question is arranged to prevent returning of the flushing medium feed flow from the feed flow channel 6*a*' to the return flow space 6*b*1 prior to drifting thereof onto the drilling surface P.

Furthermore as an advantageous embodiment particularly with reference to FIG. 4, the flushing flow arrangement 6 comprises a counterpart surface arrangement y for changing direction of the flushing medium feed flow essentially in connection with the drilling surface P particularly in order to decrease drifting thereof into the soil by decreasing its kinetic energy.

It is clear that the invention is not limited to the embodiments presented or described above, but instead it can be modified within the basic idea of the invention according to the needs at any given time. It is thus clear that the constructions of the drilling heads being illustrated in the appended drawings may vary in practice very much merely when being carried out with differing diameters. Instead of the type of embodiments shown in the appended drawings, it is naturally possible to use as the drilling device also other drilling devices that are applicable for the same purpose, in which a casing part is being exploited in connection with the drilling so that is most advantageously not rotated when being drawn into the ground. It is not that significant for the method and the apparatus according to the invention, either, how the first and second drilling means are coupled to work, so that most heterogeneous solutions can be exploited as the power transmission assemblies between the same starting from a screw joint locking. Also the casing shoe can be placed in an integrated manner at the end of the casing part etc.

The invention claimed is:

1. A method for down-the-hole drilling, the drilling being carried out by an apparatus comprising a drilling device comprising a casing and a drilling unit essentially inside the casing part at least during drilling, the drilling unit comprising a drilling head comprising a first drill configured to drill a center hole, a second drill configured to ream the center hole for the casing and a flushing flow arrangement configured to feed a flushing medium and return the flushing medium together with drilling waste at least partly internally inside the casing, the flushing flow arrangement comprising at least one feed flow channel and at least one return flow channel, the method comprising:

removably and power-transmittingly coupling the first drill with the second drill to carry out cooperation thereof at least during drilling with the second drill for at least one of a rotational motion, a feeding motion or a hammering motion and to enable removal thereof from the hole, whereby the casing is arranged to be drawn into a hole to be drilled by the drilling unit;

bringing the flushing medium with the at least one feed flow channel onto a drilling surface; and returning the flushing medium from the drilling surface together with the drilling waste with the at least one return flow channel, wherein the at least one feed flow channel and at least one return flow channel are axially directed with respect to each other, the flushing flow arrangement being placed at least partly between the first drill and the second drill, wherein when viewed in a cross section the feed flow of the flushing medium is fed to the drilling surface through the at least one feed flow channel between the first drill and the second drill on an outer periphery of the first drill and/or on an inner periphery of the second drill, and wherein the flushing medium with the drilling waste is fed from the drilling surface through the at least one return flow channel between the first drill and the second drill on an outer periphery of the first drill and an inner periphery of the second drill.

2. The method according to claim 1, wherein when operating with a drilling apparatus, in which the drilling head of the drilling device comprises a first frame part and a second frame part, the drilling surfaces of which comprise drilling organs of the first drill and the second drill, whereby a rotationally symmetrical reamer used as the second drill has an essentially continuous radial drilling surface, when viewed in a cross-section perpendicular to a longitudinal direction of the drilling unit, whereby the at least one return flow channel of the flushing flow arrangement for returning of the flushing medium and the drilling waste is axially directed and arranged between the first drill and the second drill, and whereby the flushing medium is fed from a feed channel centrically to the first drill, by at least one distribution channel directed outward from the first drill into the at least one feed flow channel arranged on the outer periphery of the first drill, at a distance from the drilling surface of the first drill, the method further comprising:

guiding passage of the flushing medium onto the drilling surface by a guide surface arrangement arranged at the drilling head of the drilling unit, thereby preventing returning of the flushing medium feed flow from the at least one feed flow channel to the return flow space prior to flow of the flushing medium onto the drilling surface.

3. The method according to claim 1, further comprising:

altering a direction of the flushing medium feed flow with a counterpart surface arrangement essentially in connection with the drilling surface particularly in order to decrease drifting thereof into the soil by decreasing its kinetic energy.

4. An apparatus for down-the-hole drilling, the apparatus comprising:

a drilling device comprising a casing and a drilling unit arranged essentially inside the casing at least during drilling, the drilling unit comprising a drilling head at which there are arranged at least a first drill for drilling a center hole, a second drill for reaming the center hole for the casing and a flushing flow arrangement for feeding of a flushing medium and for returning the flushing medium together with drilling waste at least partly internally within the casing, whereby the first drill is power-transmittedly coupled with the second drill in order to cooperate with the second drill at least during for a rotational motion, a feeding motion and/or a hammering motion, and wherein the first drill is removably coupled with the second drill in order to enable removal of the first drill from the hole, whereby the casing is arranged to be drawn into a hole to be drilled by the drilling unit, and whereby the flushing flow arrangement comprises at least one feed flow channel and at least one return flow channel that are axially directed for bringing of the flushing medium onto a drilling surface and for returning thereof together with the drilling waste from the drilling surface, the flushing flow arrangement being arranged at least partly between the first drill and the second drill, wherein when viewed in a cross section the feed flow of the flushing medium is fed to the drilling surface through the at least one feed flow channel between the first drill and the second drill on an outer periphery of the first drill and/or on an inner periphery of the second drill, and wherein the flushing medium with the drilling waste is fed from the drilling surface through the at least one return flow channel between the first drill and the second drill on an outer periphery of the first drill and an inner periphery of the second drill.

5. The apparatus according to claim 4, wherein the drilling head of the drilling device comprises a first frame part and a second frame part, the drilling surfaces of the first frame part and the second frame part comprise drilling organs of the first drill and the second drill, whereby the second drill comprises a rotationally symmetrical reamer having an essentially continuous radial drilling surface, when viewed in a cross-section perpendicular to a longitudinal direction of the drilling unit, whereby the at least one return flow channel of the flushing flow arrangement for returning of the flushing medium and the drilling waste is axially directed and arranged between the first drill and the second drill, and whereby the at least one feed flow channel of the flushing flow arrangement is concentric to the first drill, and at least one distribution channel, being directed outward from the feed channel, to lead the flushing medium into the at least one fee flow channel on the outer periphery of the first drill, at a distance from the drilling surface of the first drill, wherein the flushing flow arrangement comprises a guide surface arrangement configured to guide passage of the flushing medium onto the drilling surface at the drilling head of the drilling unit, wherein the guide surface arrangement prevents return of the flushing medium feed flow from the at least one feed flow channel to a return flow space prior to flow of the flushing medium onto the drilling surface.

6. The apparatus according to claim 4, wherein the flushing flow arrangement comprises a counterpart surface arrangement for altering direction of the flushing medium feed flow essentially in connection with the drilling surface particularly in order to decrease drifting thereof into the soil by decreasing its kinetic energy.

* * * * *